US006079944A

United States Patent [19]

Tomita et al.

[11] Patent Number: 6,079,944

[45] Date of Patent: Jun. 27, 2000

[54] GAS TURBINE STATIONARY BLADE DOUBLE CROSS TYPE SEAL DEVICE

[75] Inventors: Yasuoki Tomita; Kenichi Arase; Naoki Hagi; Hiroki Fukuno, all of Takasago, Japan

[73] Assignee: Mitsubishi Heavy Industries, Ltd., Tokyo, Japan

[21] Appl. No.: 09/175,990

[22] Filed: Oct. 21, 1998

[30] Foreign Application Priority Data

Oct. 21, 1997 [JP] Japan ..... 9-288415

[51] Int. Cl.[7] ..... F01D 9/04; F01D 11/00

[52] U.S. Cl. ..... 415/139; 415/191; 277/630; 277/643; 277/644

[58] Field of Search ..... 415/135, 138, 415/139, 191; 277/630, 643, 644

[56] References Cited

U.S. PATENT DOCUMENTS

| | | | |
|---|---|---|---|
| 3,519,366 | 7/1970 | Campbell | 415/138 |
| 3,542,483 | 11/1970 | Gagliardi | 415/139 |
| 3,801,220 | 4/1974 | Beckershoff | 415/139 |
| 3,975,114 | 8/1976 | Kalkbrenner | 415/138 |
| 4,524,980 | 6/1985 | Lillibridge et al. | 415/191 |
| 5,249,920 | 10/1993 | Shepherd et al. | 415/135 |
| 5,655,876 | 8/1997 | Rock et al. | 415/139 |
| 5,868,398 | 2/1999 | Maier et al. | 415/139 |

*Primary Examiner*—Christopher Verdier
*Attorney, Agent, or Firm*—Wenderoth, Lind & Ponack, L.L.P.

[57] ABSTRACT

Seal plates for gas turbine stationary blade inner shrouds are made in a double cross type seal structure with a view to enhance sealing ability. Seal plates 1, 2 are mutually lapped and disposed in a turbine axial direction between inner shrouds 12 of stationary blades 11. End portion seal plate 5 is lapped on an end portion of the seal plate 2 and end portion seal plate 6 is lapped under an end portion of the seal plate 1. All these seal plates are fitted with their side end portions being inserted into groove 9*a* provided in the inner shrouds 12. Seal plates 3, 4 and seal plates 7, 8 engaged with the seal plates 3, 4 are also fitted between flange portions of the inner shrouds 12 with their side end portions being inserted into grooves 10*a*, 10*b* and grooves 9*b*, 9*c*, respectively. All the seal plates 1 to 8 are fitted between mutually opposing inner shrouds in turbine circumferential direction so as to cover cavity 24 between mutually adjacent shrouds, so that gaps between engaged portions of each seal plate and between the seal plates and seal ring support ring 13 are eliminated, thereby seal air 20 is prevented from leaking from the cavity 24.

2 Claims, 5 Drawing Sheets

GAS TURBINE STATIONARY BLADE DOUBLE CROSS TYPE SEAL DEVICE

BACKGROUND OF THE INVENTION

1. Field of the Invention

The present invention relates to a double cross type seal device for reducing air leakage through seal plates between mutually adjacent inner shrouds of gas turbine stationary blades.

2. Description of the Prior Art

FIG. 4 is a cross sectional view showing a prior art fitting state of seal plates between gas turbine stationary blade inner shrouds which are mutually adjacent in a turbine circumferential direction and FIG. 5 is a cross sectional view taken on line B—B of FIG. 4. In FIGS. 4 and 5, numeral 11 designates a stationary blade and numeral 12 designates an inner shroud thereof. Numeral 31 designates a moving blade, which is adjacent to the stationary blade 11 in a turbine axial direction, and numeral 32 designates a platform of the moving blade 31. Numeral 13 designates a seal ring support ring provided in the inner shroud 12 and numeral 14 designates a labyrinth seal, which is supported by the seal ring support ring 13 to provide a seal for rotating portions. Numerals 15, 16 designate seals provided respectively at both end portions in the turbine axial direction of the inner shroud 12, said seals constructing seal portions of seal air for platform end portions of adjacent front and rear moving blades.

Numeral 17 designates a seal plate, which is fitted with its side end portion being inserted into a groove 21 provided along the turbine axial direction in the inner shroud 12. Numerals 18, 19 designate also seal plates, which are disposed respectively in side end portions of front and rear flanges of the inner shroud 12 so as to be substantially orthogonal to the seal plate 17 and are fitted with their respective side end portions inserted into grooves 22, 23 provided in the side end portions of the flanges.

These seal plates 17, 18 and 19, as shown in FIG. 5, are fitted with their respective side end portions inserted into the grooves provided in the stationary blade inner shrouds 12, 12' which are mutually adjacent in the turbine circumferential direction, wherein the seal plate 17 is inserted between the grooves 21, 21', the seal plate 18 is inserted between the grooves 22, 22' and the seal plate 19 is inserted between the grooves 23 (FIG. 4), thereby a seal portion is constructed so as to surround a cavity 24.

In the construction of seal plates as mentioned above, seal air 20 is supplied into the cavity 24 from a seal air supply pipe provided in an interior of the stationary blade 11 partly to pass through a hole 25 provided at a front portion of the seal ring support ring 13 and then like arrows 20*a*, 20*b* through a space between a mutually adjacent stationary blade and moving blade and to flow out of a seal 15 like arrow 20*c*. Also, the seal air 20 partly passes through a hole 26 provided at a rear portion of the seal ring support ring 13 and then like arrows 20*d* and 20*e* through a space between a mutually adjacent stationary blade and moving blade and to flow out of a seal 16.

While an interior of the cavity 24 is thus maintained by the seal air 20 at a higher pressure than in an outside combustion gas passage so that a high temperature outside combustion gas is prevented from coming in there, the seal air 20 in the cavity 24 leaks from a gap of a joint portion of the seal plate 17 and the seal plate 18, like arrow 20*f*, and from a gap between an inner end portion of the seal plate 18 and the seal ring support ring 13, like arrow 20*g*. Likewise, the seal air 20 leaks from a gap between the seal plate 17 and the seal plate 19, like arrow 20*h*, and from a gap between an inner end portion of the seal plate 19 and the seal ring support ring 13, like arrow 20*i*. Thus, not a small amount of the seal air 20 leaks from gaps of the seal plates 17, 18 and 19 resulting in a lowering of the sealing ability.

In the prior art construction of the gas turbine stationary blade seal plates as mentioned above, there are two places of air leaking gaps between the seal plate 17 and the seal plates 18, 19 and also two places of air leaking gaps between the inner end portions of the seal plates 18, 19 and the seal ring support ring 13 and this leakage of air causes lowering of the sealing ability. Also, said leakage of air increases the load of the compressor, which results in a lowering of the entire gas turbine performance.

SUMMARY OF THE INVENTION

In view of the foregoing problem in the prior art, it is an object of the present invention to provide a gas turbine stationary blade double cross type seal device in which a construction of gas turbine stationary blade seal plates is improved such that there is eliminated a gap of a joint portion of seal plates and also there is eliminated a gap between seal plate end portions and a seal ring support ring resulting in no leakage of seal air from a cavity.

In order to attain said object, the present invention provides the following means:

1. A gas turbine stationary blade double cross type seal device comprising a seal plate provided between gas turbine stationary blade inner shrouds which are mutually adjacent in a turbine circumferential direction and front and rear seal plates provided at front and rear portions in a turbine axial direction between said inner shrouds on an inner side of said seal plate and disposed in an orthogonal direction to said seal plate, all said seal plates being for covering and sealing a cavity formed by said inner shrouds and a seal ring support ring, characterized in that said seal plate consists of two plates which are mutually lapped at a central portion in the turbine axial direction of said inner shrouds, each of said two plates having a slit provided in a plate widthwise direction at each end portion thereof, each of said front and rear seal plates has a slit provided in a plate widthwise direction at one end portion thereof and the slits of said front and rear seal plates are mutually engaged with the slits of said two plates so that said two plates and each of said front and rear seal plates are assembled in a cross shape respectively, and there is provided at the other end portion each of said front and rear seal plates a seal ring support ring seal plate for sealing a gap in and around said seal ring support ring.
2. A gas turbine stationary blade double cross type seal device as mentioned in (1) above, characterized in that there are provided end portion seal plates lappedly at both lengthwise end portions of said two plates.

In the present invention of 1. above, there are provided slits in the seal plate disposed between the mutually adjacent inner shrouds and in the front and rear seal plates of the turbine axial direction, each of said slits having a width which is slightly larger than the thickness of the opponent plate and a length of approximately a half of plate width, and the slits of the seal plate and each of the front and rear seal plates are engaged with each other so as to be assembled in a cross shape respectively and the plate width after assembled in the cross shape is constant for all of the seal plates. The seal plates so assembled are fitted between the mutually adjacent inner shrouds with their both side end portions being inserted into the grooves provided in the mutually opposing surfaces of said inner shrouds. Thus, there is caused no gap as in the prior art at the engaged portions of the seal plates and there arises no leakage of seal air from the cavity. Also, the seal plate consists of two plates which are mutually lapped at the central portion of the inner shrouds and the seal plates are mutually slidable, hence there is caused no restraining force between the engaged portions of the cross shape with no force due to thermal elongation being added and thus a construction which is not affected by thermal stress is provided. Further, there are provided the seal ring support ring seal plates at the other end portions of the front and rear seal plates and there is caused no gap in and around the seal ring support ring, hence there arises no leakage of seal air from this portion also.

Thus, leakage of seal air from the cavity is reduced, hence the seal air is made use of effectively, the sealing ability is enhanced and the load burden by the compressor due to leakage of seal air can be alleviated.

In the invention of 2. above, there are provided end portion seal plates lappedly at both lengthwise end portions of said two plates, thus when the end portion seal plates are assembled in the seal device, they may form one same thickness as that of said two plates at both lengthwise end portions and the central portion thereof and the grooves into which these seal plates are inserted can be made with a constant width and work of the groove can be facilitated.

Figure 1:
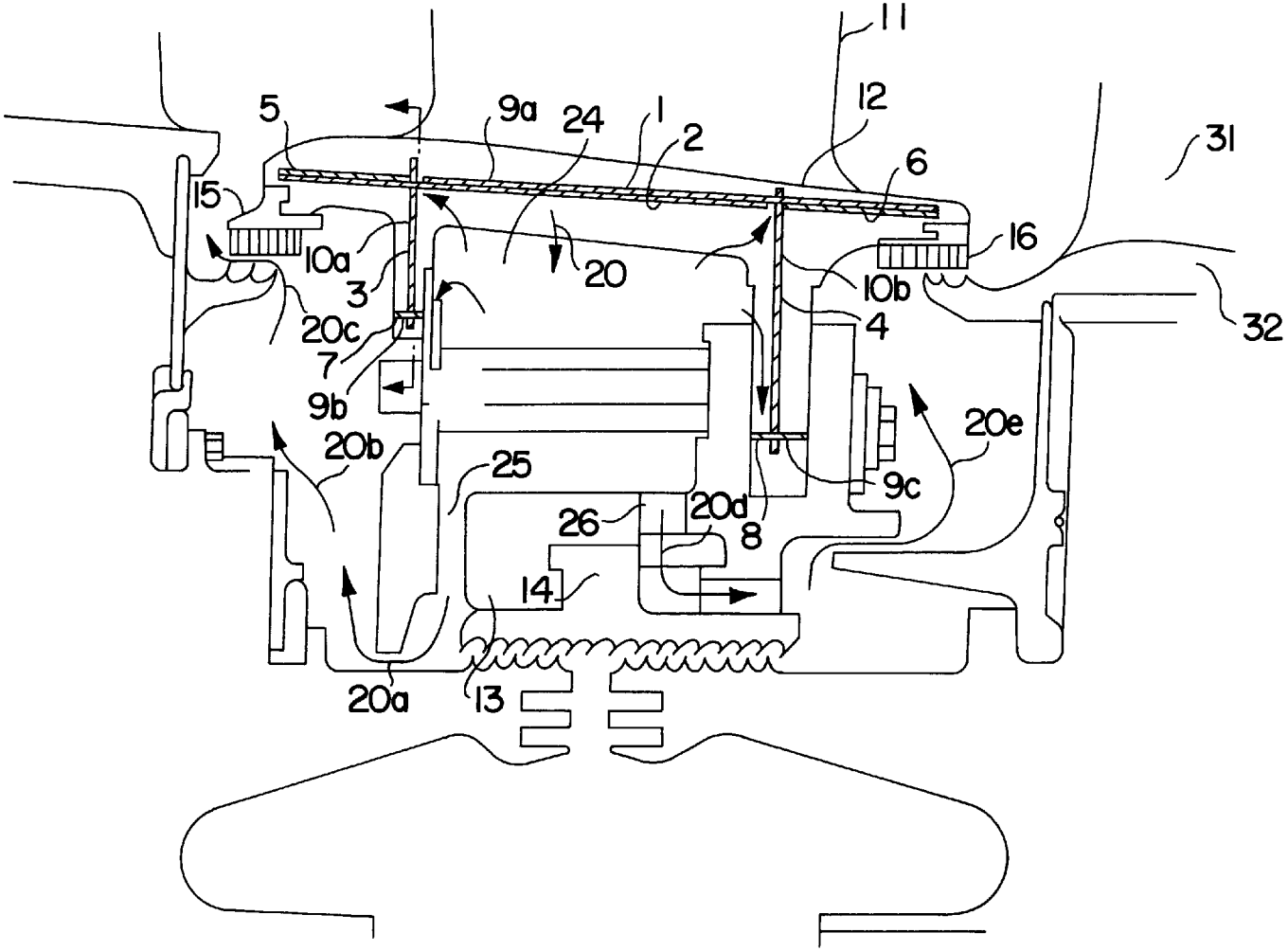
FIG. 1 is a cross sectional view showing a fitting state of a gas turbine stationary blade double cross type seal device of an embodiment according to the present invention.
Figure 2:
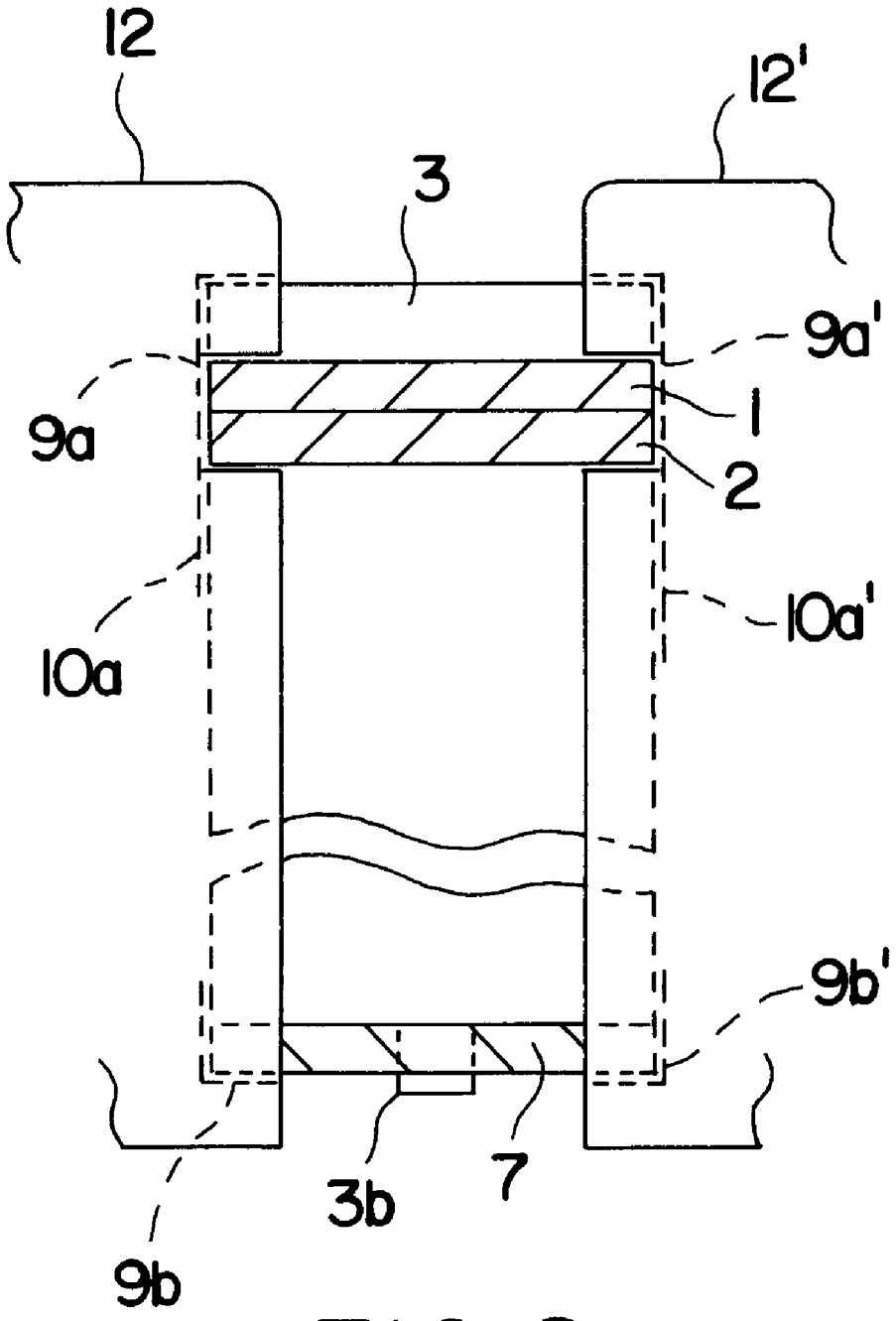
FIG. 2 is a cross sectional view taken on line A—A of FIG. 1.
Figure 3:
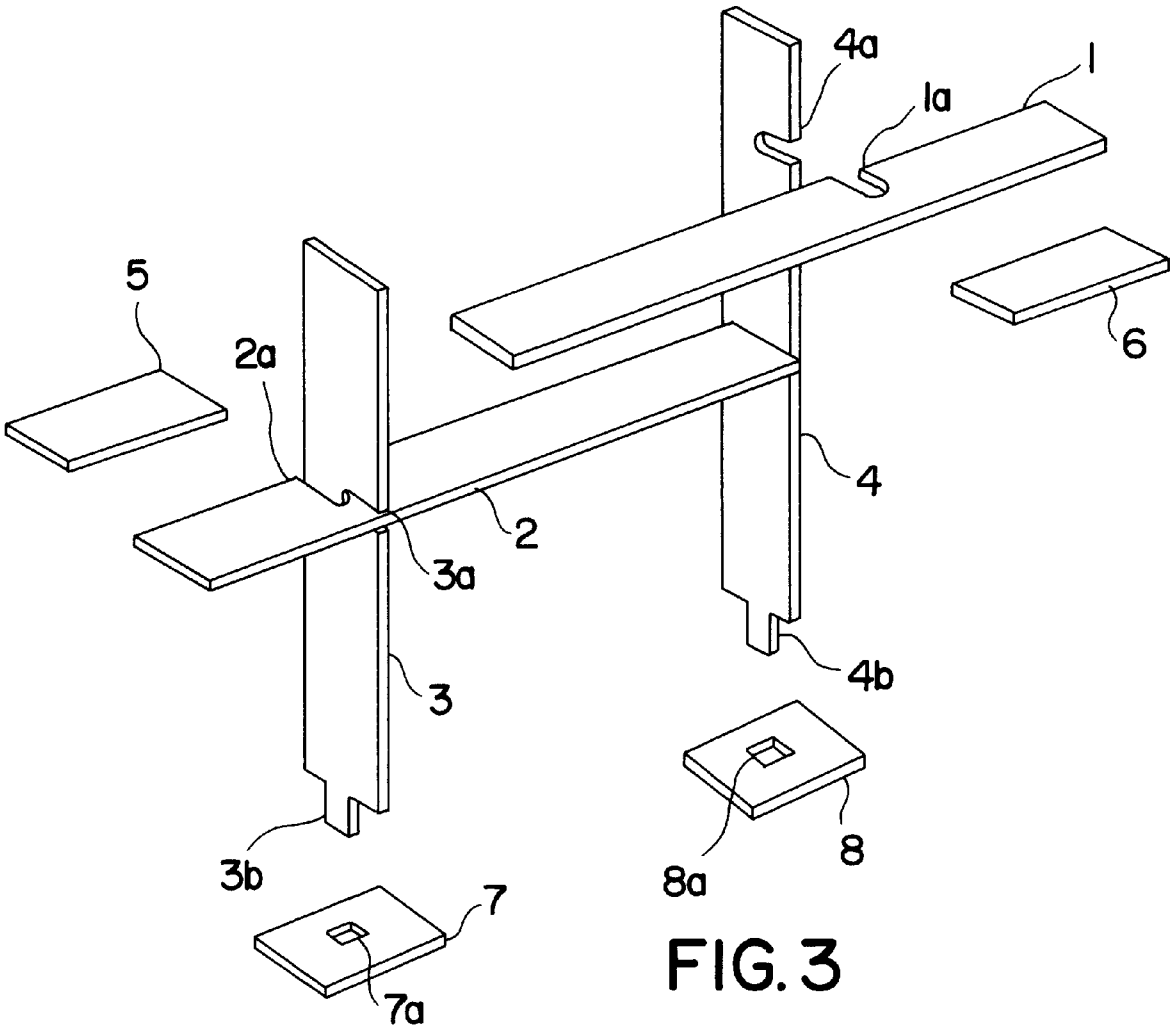
FIG. 3 is a perspective view showing an assembling state of seal plates of the seal device of FIG. 1.
Figure 4:
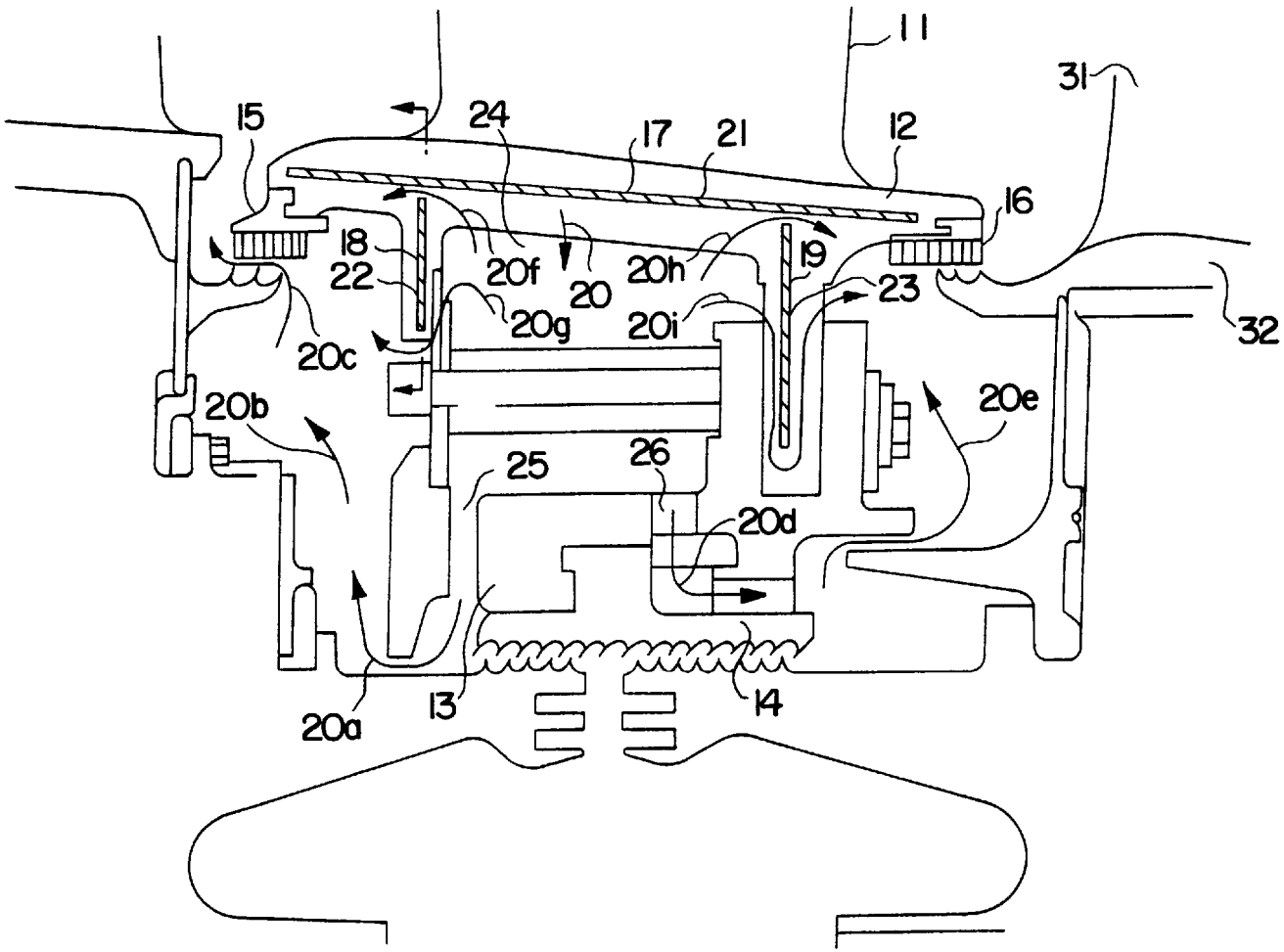
FIG.4 PRIOR ART
FIG. 4 is a cross sectional view showing a prior art fitting state of seal plates in gas turbine stationary blades.
Figure 5:
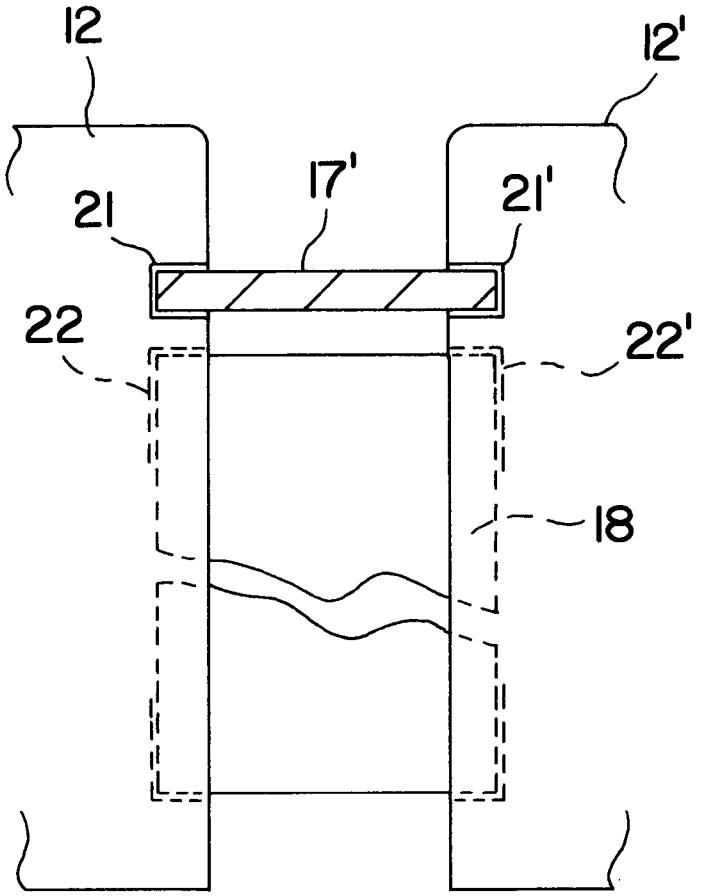
FIG.5 PRIOR ART
FIG. 5 is a cross sectional view taken on line B—B of FIG. 4.

DESCRIPTION OF THE PREFERRED EMBODIMENT:

Herebelow, description will be made concretely on an embodiment according to the present invention with reference to figures. FIG. 1 is an entire cross sectional view showing the fitting state of a gas turbine stationary blade double cross type seal device of an embodiment according to the present invention, FIG. 2 is a cross sectional view taken on line A—A of FIG. 1 and FIG. 3 is a perspective view showing an assembling state of seal plates of the seal device of FIG. 1. In FIG. 1, numerals 11 to 16 and 24 to 26 designate same parts of construction as those of the prior art shown in FIG. 4 with description thereon being omitted, and the feature of the present invention, that is, seal plates 1 to 8 and grooves 9 and 10 provided in an inner shroud for insertion thereinto of the seal plates, will be described below.

In FIG. 1, numerals 1, 2 designate seal plates, wherein the seal plate 1 is lapped on the seal plate 2 and both of them are fitted with their side end portions being inserted into the groove 9*a* provided along a turbine axial direction in the inner shroud 12. Numerals 3, 4 designate also seal plates and as will be described later in FIG. 3, the seal plate 3 and the seal plate 2 are assembled with each other in a cross shape and likewise the seal plate 4 and the seal plate 1 are assembled with each other in a cross shape. The seal plates 3, 4 are fitted with their side end portions being inserted into grooves 10*a*, 10*b*, respectively, provided in side end portions of flanges of the inner shroud 12.

Numerals 5, 6 designate end portion seal plates, which are fitted with their side end portions being inserted into the groove 9*a* together with the seal plates 2, 1, wherein the end portion seal plate 5 is lapped on the seal plate 2 and the end portion seal plate 6 is lapped under the seal plate 1, so that the end portion seal plate 5 and the seal plate 2 as well as the end portion seal plate 6 and the seal plate 1, being lapped one on the other respectively, form a constant thickness of plates as a whole. Thus, when all these seal plates 5, 2 and 6, 1 are assembled and inserted into the groove 9*a*, they form one same thickness as that of the two seal plates 1 and 2 at both end portions and a central portion thereof, hence the groove 9*a* can be made with a constant width and work of the groove can be facilitated.

Numerals 7, 8 designate seal ring support ring seal plates, which as will be described later in FIG. 3, have holes at central portions thereof into which end portions of the seal plates 3, 4 are inserted respectively, and are fitted with their side end portions being inserted respectively into grooves 9*b*, 9*c* provided in the side end portions of the flanges of the inner shroud 12.

FIG. 2, being a cross sectional view taken on line A—A of FIG. 1, shows a fitting state of the seal plates between mutually adjacent inner shrouds 12, 12' in a turbine circumferential direction. In FIG. 3, the seal plate 3 is fitted with its both side end portions being inserted into grooves 10*a*, 10*a*' of the inner shrouds 12, 12' so as to close a front portion of the cavity 24. The seal plates 1, 2, being lapped one on the other, are fitted with their both side end portions being inserted into mutually adjacent grooves 9*a*, 9*a*' so as to seal an upper portion of the cavity 24. The seal plate 4 is likewise fitted with its both side end portions being inserted into the grooves 10*b*, 10*b*' so as to seal a rear portion of the cavity 24 and also front and rear portions of the seal plates 1, 2 lapped with the end portion seal plates 5, 6 are fitted with their side end portions being inserted into the grooves 9*a*, 9*a*'.

Likewise in FIG. 2, the seal ring support ring seal plate 7 is fitted with its both side end portions being inserted into the groove 9*b* provided in the side end portion of the flange of the inner shroud 12 and into a groove 9*b*' provided opposingly to the groove 9*b* in the flange of the inner shroud 12' so as to close a gap at the front portion of the seal ring support ring 13. The seal plate 8 is likewise fitted with its both side end portions being inserted into the grooves 9*c*, 9*c*', although not shown in FIG. 2, so as to seal a gap at the rear portion of the seal ring support ring 13.

In FIG. 3 which shows an assembling state of the seal plates 1 to 8 described above, each of the seal plates has the same width and there are worked a slit 1*a* in the seal plate 1 and a slit 4*a* in the seal plate 4, wherein each of the slits 1*a*, 4*a* has a length of a half of the width of the seal plate and a width which is slightly larger than a thickness of the seal plate so that the seal plate may be inserted thereinto. Thus, the seal plates 1, 4 may be mutually inserted into the slits 4*a*, 1*a* so as to be assembled to form a cross shape. Likewise, there are worked a slit 2*a* in the seal plate 2 and a slit 3*a* in the seal plate 3 and the seal plates 2, 3 are mutually inserted into the slits 3*a*, 2*a* to form a cross shape.

Further, there are provided projection portions 3*b*, 4*b* in the seal ring support ring seal plates 3, 4, respectively, and also there are provided holes 7*a,* 8*a* at central portions of the seal plates 7, 8, respectively, so that the projection portions 3*b,* 4*b* of the seal plates 3, 4 are inserted into the holes 7*a,* 8*a* and the seal plates 3, 4 and the seal ring support ring seal plates 7, 8 are assembled together respectively. The end portion seal plate 5 is placed on one end portion of the seal plate 2 so as to be lapped thereon and the end portion seal plate 6 is placed under one end portion of the seal plate 1 so as to be lapped thereunder.

As for each of the seal plates shown in FIGS. 1 and 2 and described above, the seal plates 1, 2, are mutually lapped, and the end portion seal plates 4, 5 of both end portions thereof are inserted into the grooves 9*a,* 9*a*', and likewise the seal plate 3 into the grooves 10*a,* 10*a*', the seal plate 4 into the grooves 10*b,* 10*b*', the seal ring support ring seal plate 7 into the grooves 9*b,* 9*b*' and the seal ring support ring seal plate into the grooves 9*c,* 9*c*', respectively, so that a double cross type seal device is constructed. With this construction, even if there is caused a deformation of the seal plates 1, 2 due to thermal elongation, the seal plates 1, 2 are mutually slidable and two engaged portions of the seal plates 1 and 4 and the seal plates 2 and 3 are mutually separated and not restrained, hence there arises no bad influence by the thermal deformation.

In the double cross type seal device as described above, seal air 20 supplied through the stationary blade 11 flows into the cavity 24 partly to pass through the hole 25 provided at the front portion of the seal ring support ring 13 and then like arrows 20*a,* 20*b* through a space between a mutually adjacent stationary blade and moving blade and to flow out of the seal 15 like arrow 20*c.* Also, the seal air 20 partly passes through the hole 26 provided at the rear portion of the seal ring support ring 13 and then like arrow 20*e* through a space between a mutually adjacent stationary blade and moving blade and to flow out of the seal 16. Thus, an interior of the cavity 24 is maintained at a higher pressure than in an outside combustion gas passage and a high temperature gas is prevented from coming into the inner shroud 12.

In the seal device mentioned above, the seal plates covering the cavity 24 form a double cross type seal which is constructed to cause no gap as seen in the prior art seal, and seal air pressure in the cavity 24 is maintained securely without leakage of the seal air from engaged portions of each of the seal plates, hence the seal ability is enhanced, the seal air led from compressor is utilized efficiently and a lowering of the gas turbine performance can be prevented also.

As the result of sealing experiments done by the inventors here using an actual seal device of the present invention, it is confirmed as a reduction effect of the leakage air that the air leakage amount is reduced to approximately ½ of that of the prior art seal device.

It is to be noted that the above described embodiment can be applied to any of an air cooled type stationary blade and a steam cooled type stationary blade and also can be applied to any type of gas turbine if it has a construction to seal the cavity by seal plates provided in the inner shrouds.

While the preferred form of the invention has been described, variations thereto will occur to those skilled in the art within the scope of the present inventive concepts which are delineated by the following claims.

What is claimed is:

1. A gas turbine stationary blade double cross type seal device comprising a seal plate provided between gas turbine stationary blade inner shrouds which are mutually adjacent in a turbine circumferential direction and front and rear seal plates provided at front and rear portions in a turbine axial direction between said inner shrouds on an inner side of said seal plate and disposed in an orthogonal direction to said seal plate, all said seal plates being for covering and sealing a cavity formed by said inner shrouds and a seal ring support ring, wherein said seal plate consists of two plates which are mutually lapped at a central portion in the turbine axial direction of said inner shrouds, each of said two plates having a slit provided in a plate widthwise direction at an end portion thereof, each of said front and rear seal plates has a slit provided in a plate widthwise direction at one end portion thereof and the slits of said front and rear seal plates are mutually engaged with the slits of said two plates so that said two plates and each of said front and rear seal plates are assembled in a cross shape respectively, and there is provided at the other end portion of each of said front and rear seal plates a seal ring support ring seal plate for sealing a gap in and around said seal ring support ring.

2. A gas turbine stationary blade double cross type seal device as claimed in claim 1, wherein there are provided end portion seal plates each lapped at a respective lengthwise end portion of a respective one of said two plates.

* * * * *